United States Patent [19]

Fox

[11] Patent Number: 5,037,491

[45] **Date of Patent: * Aug. 6, 1991**

[54] SHALLOW CASE HARDENING AND CORROSION INHIBITION PROCESS

[76] Inventor: Patrick L. Fox, 1684 Graefield, Birmingham, Mich. 48008

[ * ] Notice: The portion of the term of this patent subsequent to Jul. 12, 2005 has been disclaimed.

[21] Appl. No.: 207,327

[22] Filed: Jun. 15, 1988

Related U.S. Application Data

[63] Continuation of Ser. No. 834,907, Feb. 28, 1986, Pat. No. 4,756,774, which is a continuation-in-part of Ser. No. 646,564, Sep. 4, 1984, abandoned.

[51] Int. Cl.[5] ..... C21D 1/74

[52] U.S. Cl. ..... 148/16.5; 148/16.6; 148/318; 148/319

[58] Field of Search ..... 148/16, 16.5, 16.6, 148/203, 318, 319, 316, 317

[56] References Cited

U.S. PATENT DOCUMENTS

| | | | |
|---|---|---|---|
| 3,658,602 | 4/1972 | Pomey | 148/14 |
| 3,912,547 | 10/1975 | Gaucher et al. | 148/15.5 |
| 4,131,492 | 12/1978 | Fushini | 148/16.6 |
| 4,249,889 | 2/1981 | Kemp | 432/11 |
| 4,292,094 | 9/1981 | Kunst et al. | 148/15.5 |
| 4,406,714 | 9/1983 | Bowes et al. | 148/16.6 |
| 4,410,373 | 10/1983 | Kemp | 148/16 |
| 4,440,582 | 4/1984 | Smith et al. | 148/243 |
| 4,448,611 | 5/1984 | Grellet et al. | 148/15.5 |
| 4,496,401 | 1/1985 | Daves et al. | 148/16.5 |
| 4,534,794 | 8/1985 | Walter et al. | 148/15.5 |
| 4,547,228 | 10/1985 | Girrell et al. | 148/16 |
| 4,563,223 | 1/1986 | Dawes et al. | 145/16.5 |
| 4,596,611 | 6/1986 | Dawes et al. | 148/16.5 |
| 4,608,092 | 8/1982 | Tremovreux et al. | 148/15 |
| 4,671,496 | 6/1987 | Girrell et al. | 266/78 |
| 4,710,238 | 12/1987 | Dawes | 148/16.6 |

FOREIGN PATENT DOCUMENTS

| | | |
|---|---|---|
| 0074211 | 4/1977 | European Pat. Off. . |
| 0122762 | 10/1984 | European Pat. Off. . |
| 119822 | 5/1976 | Fed. Rep. of Germany . |
| 47-5516 | 10/1973 | Japan . |
| 2138028 | 10/1984 | United Kingdom . |
| 2170824 | 8/1986 | United Kingdom . |

OTHER PUBLICATIONS

Japka, J. E., "Using the Fluidized Bed for Nitriding-Type Process", Metals Progress, vol. 123, No. 2, Feb. 1983, pp. 1-6.

Boiko, K., "California Shop Comes In-House for Heat Treating Extrusions Dies", Heat Treating, vol. 14, No. 5, May 1982, 3 pages.

Boiko, K., "Tool and Die Specialists Aim to Out-Fox the Slump in Detroit", Heat Treating, Aug. 1983, pp. 26-29.

Lasday, S. B., "Heat Treating Print Marking Machine Parts in Versatile Fluidized Bed Furnaces", Industrial Heating, vol. L, No. 9, Sep. 1983, 4 pages.

T. Bell, "The Theory and Practice of Thermochemical Processing Using Fluidized Beds".

Z. Rogalski, "Fluidized Bed Methods of Nitriding and Oxy-Nitriding", Proceedings of the 18th International Conf. on Heat Treatments of Materials, 5/6-8/80, pp. 181-196.

C. Dawes et al., "Reappraisal of Nitrocarburizing . . . ", Heat Treatment '79, pp. 60-68 (May 22-24, 1979).

C. Dawes et al., "Nitrotec Surface Treatments . . . ", Heat Treatments of Metals (Apr. 1982), pp. 85-90.

C. Dawes et al., "Sub-atmospheric Oxynitrocaburizing", Heat Treatment '73, pp. 110-120, (P113).

C. Dawes et al., "Nitrotec Surface Treatment Technology", Heat Treatment of Metals (1985), pp. 70-76.

C. Dawes et al., "Nitriding Non-Alloy Steel Components", Heat Treatment of Metals (1980), pp. 1-4.

Japka J. E., "Fluidized Bed Furnace Heat Treating Applications for the Die Casting Industry", Die Casting Engineer, vol. 27, No. 3, May/Jun. 1983.

Lasday S. B., "Relatively New Heat Treatments Expand Available Parameters to Allow Superior Performance of Metals", Industrial Heating, Mar. 1988, pp. 34-37.

*Primary Examiner*—John J. Zimmerman

*Attorney, Agent, or Firm*—Basile and Hanlon

[57] ABSTRACT

A method for improving the wear characteristics and corrosion resistance of a metal surface having the basic steps of:

A. case hardening the metal surface by placing the metal in a fluidized bed and exposing it to a first atmosphere of nitrogen, ammonia and natural gas at a temperature between about 750° F. and about 1200° F. for a period between about 1 and about 5 hours, followed by exposure to a second atmosphere containing nitrogen and water at a temperature between about 750° F. and about 1200° F.;

B. coating the metal with an aqueous coating composition consisting essentially of a polymeric additive and water; and C. allowing the coating composition retained on the metal to cure for a period between about 2 and about 48 hours.

20 Claims, No Drawings

SHALLOW CASE HARDENING AND CORROSION INHIBITION PROCESS

Related Applications

This application is a continuation of U.S. Ser. No. 834,907, filed Feb. 28, 1986, now U.S. Pat. No. 4,756,774, which itself is a continuation-in-part of U.S. Ser. No. 646,564, filed Sept. 4, 1984 now abandoned.

BACKGROUND OF THE INVENTION

1. Field of the Invention

This invention relates to shallow case hardening process and a post-hardening method of improving the corrosion resistance of shallow case hardened metals.

2. Description of the Prior Art

In the past, it has been a common practice in heat treating of metal work pieces to use fluid beds, such as those made by Procedyne Corporation of New Brunswick, N.J. An example of these fluidized beds is designated 18502048HT, standing respectively for: 1850 degrees F., 20 inch diameter, 48 inch depth. These are, essentially, furnaces that have a sand-like bed, where the sand is made of aluminum oxide. A diffusion plate is underneath the sand, in the sense that the top of a coffee percolator has little holes in it for diffusing water, except that the holes in this case are filled with small screws that are countersunk but not entirely screwed in, and they are oversized holes with respect to the shafts of the countersunk screws, so that a small passageway is created for flow of gasses through the diffusion plate underneath the bed of aluminum oxide.

These fluidized beds are used for carborizing, nitrocarborizing, carbonitriding, and nitro-hardening. In the case of nitro-hardening, temperatures of approximately 1500° F. are used, in an austenitizing type process, to provide core-hardening as opposed to case-hardening of parts. In carborizing, temperatures of approximately 1750° F. are used to provide case-hardening at a high temperature with high carbon content. Nitrocarborizing refers to providing case-hardening with a relatively larger nitrogen content at temperatures of approximately 1050° F. Carbonitriding is provided at temperatures of approximately 1600° F. for a higher carbon content of the mixture of carbon and nitrogen in providing the case-hardening for high Rockwells at surface. While nitrocarborizing is a light case process which occur at low temperature giving high surface hardness without a lot of depth; the opposite is true of carbonitriding which occurs at a higher temperature, and provides a deeper case hardening. The case hardening in carborizing is about 60 thousandths of an inch deep; in carbonitriding it is about 15 to about 20 thousandths of an inch deep; and in nitrocarborizing it is about 3 to about 5 thousandths of an inch deep.

Another process for finishing metal is the Quench-Polish-Quench (or Q.P.Q.) Process for applying corrosion resistance. The Q.P.Q. Process is inadequate because, while providing excellent corrosion characteristics, it destroys the hardening characteristics required, and this has dramatic results affecting tool life and possible failure.

Past experience with the Procedyne Process in the way it has been used provides excellent increases in Rockwell and case-hardening, as opposed to core-hardening. Prior to the subject invention, it had not been considered using processes analogous to the Procedyne Process for achieving not only case-hardening but, simultaneously, corrosion resistance.

Prior to this time, a blanket rule of thumb recommended by Procedyne, and used throughout the industry, was a standard half-hour saturation in the bed at fluid flows of approximately, or at least not exceeding 800 cubic feet per hour. This method employed the following as a standard flow, standard diffusion at the end of the cycle, standard temperature, and standard time within the furnace prior to diffusion: two hours is nitrocarborizing atmosphere, onehalf hour diffusion time, 800 cubic feet per hour total gas flows--its various components are as follows: 35 percent ammonia, 45 percent natural gas, 10 percent nitrogen. This process, while case hardening the treated metal, imparted little or no corrosion resistance.

In certain applications, it is necessary to use metals with even higher degrees of corrosion resistance. Various surface coatings have been proposed for this purpose. Drawbacks to such methods have been many. To date, no process has been found which will yield a metal having increases in Rockwell surface hardness and suitable corrosion inhibitory effects in highly corrosive environments. The corrosion inhibition processes employed heretofore either degrade the case hardened surface or imparts an inhibited surface which wears away quickly under constant use, leaving the metal vulnerable to corrosive forces.

Furthermore, where corrosion inhibiting surface coatings such as conventional paints are applied to conventionally case hardened metals, flaws, imperfections or cracks in the coating will permit corrosive materials access to the metal. It has been found that cracks and the like in an otherwise coated metal will increase the corrosive effects. This can lead to weakening of the part, localized destruction of the case hardened surface and eventual premature part failure.

Thus, it is desirable to provide a process in which a metal surface is case hardened and provided with a high degree of corrosion resistance. It is also desirable that the corrosion resistance and case hardening be achieved in an integral heat-treating process which is uncomplicated and inexpensive. Furthermore, it is desirable to provide a method whereby metal surfaces treated in this manner are coated with a tough long-lasting corrosion inhibiting substances which maintains the integrity and strength of the case hardened surface.

SUMMARY OF THE INVENTION

The present invention is a method for improving the wear characteristics and corrosion resistance of a metal surface comprising the basic steps of:

A. case hardening the metal surface by placing the metal in a fluidized bed and exposing it to a first atmosphere of nitrogen, ammonia and natural gas at a temperature between about 750° F. and 1200° F. for between about 1 and about 5 hours, followed by exposure to a second atmosphere containing nitrogen and water at a temperature between about 750° F. and about 1200° F.

B. coating the metal with an aqueous coating composition consisting essentially of a polymeric additive and water; and C. allowing the coating composition carried on the metal to cure for a period between about 2 and about 48 hours.

In the present invention, the case hardening process includes the following steps:

A. immersing pieces of the metal in a fluidized bed of particulate material at a temperature between about 750° F. and about 1250° F.;

B. introducing a first gaseous atmosphere into the bed, the first gaseous atmosphere selected from the group consisting of ammonia, nitrogen and natural gas while maintaining the temperature between about 750° F. and about 1250° F.;

C. maintaining the metal pieces in contact with the first gaseous atmosphere for a period between about 1 and about 5 hours;

D. replacing the first gaseous atmosphere with a second gaseous atmosphere upon expiration of the time period in step C, the second gaseous atmosphere consisting essentially of water, oxygen and nitrogen; and E. maintaining the work piece in contact with the second gaseous atmosphere for a period between about 30 minutes and about 90 minutes.

DESCRIPTION OF THE PREFERRED EMBODIMENTS

The present invention is predicated on the discovery that case hardening performed by the present method renders a metal surface having increased corrosion and wear resistance and better lubricity than is obtainable by conventional case hardening methods. It has also been unexpectedly discovered that post-treatment contact and coating with an aqueous coating solution containing certain polymeric mixtures and water further increased the corrosion resistance of the metal surface. The resulting material had a surface having hardness, wear characteristics and corrosion resistance superior to metal surfaces which were either case hardened or coated alone.

The method of the present invention has three major steps: case hardening with oxidation coating the case hardened metal with an aqueous coating compostion; and allowing the coating to cure. The method may include the optional step of additional oxidation in a salt bath which occurs immediately prior to the coating step.

In the method of the present invention, a metal piece to be treated is immersed in a fluidized bed of particulate material which is contained in a suitable furnace. The particulate material can be any suitable material already known in the heat-treating industry or any other material which is chemically inert and able to withstand the process temperatures. Examples of these materials include aluminum oxide. The furnace can be any suitable furnace which are adapted for such heat-treating applications. Manufacturers of such furnaces include Procedyne Corp. of New Brunswick, New Jersey and Fluidtherm of South Lyon, Mich.

The fluidized bed is maintained at a temperature between about 750° F. and about 1200° F. Entry of large quantities of metal to be treated into the furnace can cause temporary temperature depression. After such an occurrence, the metal can be maintained in the furnace until the original temperature is restored.

A first gaseous atmosphere may be introduced immediately after temperature equilibration. The first gaseous atmosphere is selected from the group consisting of ammonia, nitrogen and natural gas. The metal pieces are maintained in this atmosphere at a temperature between about 750° F. and about 1200° F. for about 1 to about 5 hours, preferably.

At the end of the exposure to the first gaseous atmosphere, this atmosphere is evacuated and replaced by a second gaseous atmosphere consisting essentially of nitrogen and water which can, generally, be referred to as humidified nitrogen. The gaseous atmosphere may also contain amounts of oxygen. It has been found that the presence of oxygen in the nitrogen/water atmosphere will impart a deeper oxide coating. The metal pieces are exposed to this atmosphere for a period of about 30 minutes to about 90 minutes at a temperature between about 750° F. and about 1200° F. In the preferred embodiment, the humidified nitrogen consists of between about 10 and about 20 percent, by volume, water; the balance being nitrogen. Where oxygen is used, the atmosphere will contain about 10 to about 50 percent, by volume, oxygen in addition to the other components. Humidified nitrogen can be obtained by passing dry nitrogen through a humidifier, in a manner well known in the humidifying art. Nitrogen, being hygroscopic, absorbs moisture through a humidifier and can then be passed through the fluidized bed at a rate of between about 300 and 900 cubic feet per hour. This procedure will permit humidification of approximately 10 to 20 percent.

In this manner, the case hardening step of the present invention forms an oxidized layer on top of an underlying nitrocarborized layer. The oxide layer is highly porous, which allows for its lubrication properties, while the underlying nitrocarbide layer is extremely non-porous. The depth of the oxide layer obtained during this step is approximately 0.0005 inch or 5/10 of a thousandth of an inch. Immediately below that is a while layer between about 0.001 and 0.0015 inch thick or one to one-and-one-half of a thousandth of an inch thick. However, the white layer can be as shallow as 3/10 of a thousandth of an inch without impairing function of the processed piece. This white layer contains high concentrations of nitrogen. Immediately below the white layer is a zone containing diffused nitrogen. This diffused nitrogen zone is approximately 0.006 inches or six thousandth of an inch thick.

This contrasts with the Procedyne process described previously. In that process, there is no oxide layer. Furthermore, the white layer produced is about 0.0001 to about 0.0002 inches (about 1/10 to about 2/10 of a thousandths of an inch) deep; while the nitride layer is about 0.002 to about 0.003 inches (about two to three thousandths of an inch) deep. Thus, this case hardening process provides an extraordinarily deep loading of fifty to a hundred times ordinary case hardened depths. This provides significantly greater hardening and corrosion resistant properties.

One specific example of the nitrocarborizing step of the present invention is as follows. In making parts, specifically a chain for front-wheel drive, the time would be 3 hours in the first gaseous atmosphere. Eight hundred pounds of work pieces are placed in the furnace. At this temperature, it will take about 30 minutes for the furnace to reach its equilibrium temperature of 980° F. The first gaseous atmosphere consisting of nitrogen, ammonia and natural gas is then introduced at a rate of about 250 cubic feet of nitrogen per hour, about 900 cubic feet of ammonia per hour, and about 350 cubic feet of natural gas per hour. The work pieces are held at 980° F. in the first gaseous atmosphere for about 3 hours. This phase is then followed by exposure to humidified nitrogen, preferably for about an hour and a half.

In an alternate embodiment of this invention, the parameters would change for a cutting-type tool, such as an end mill. In this embodiment, the process temperature would be lowered to about 950 degrees Fahrenheit. The total atmosphere total flow rates would remain the same, while time in the humidified nitrogen atmosphere would be reduced to about 30 minutes (a 30 minute diffusion of humidified nitrogen). The resulting metal piece would have an oxide layer depth of about 0.0005 to about 0.0007 (5/10 to 7/10 of a thousandth of an inch). The oxide layer produced cuts down the welding effect of chips on the cutting edge.

The depth of the oxide layer can be increased, if desired, by exposing the metal to an oxidizing salt at a temperature between about 650° F. and about 1000° F. for a period between about 15 minutes and about 2 hours. It is to be understood that the depth of the porous oxide layer will vary depending upon the oxidizing conditions. However, oxide layers of between 7/10 to one thousandth of an inch are obtainable in this manner. The oxidizing salt employed in this invention can be any of those known in the art. However, an oxidizing salt such as various nitrate salts, are preferred. Where deeper oxide layers are not required, this step can be omitted entirely.

After an oxide layer of suitable depth has been produced on the outer surface of the metal piece, that piece is maintained in contact with an aqueous coating composition consisting essentially of a polymeric additive and water for a period between about 5 seconds and about 5 minutes. The polymeric additive is present in an amount between 5 percent and 35 percent, by volume, based on the total volume of the coating composition. The balance of the composition is water. The polymeric additive preferably employed in the present invention is a proprietary composition marketed by Ashland Petroleum Co. of Ashland, Ky. Other substances which may be suitable for use in the present inventions are those discussed un U.S. Pat. No. 4,440,582 to Smith which is herein incorporated by reference. In general, such substances may contain phosphating oils and polysiloxane compounds along with other components.

In substances such as those disclosed in U.S. Pat. No. 4,440,582 to Smith the phosphating oil is understood to be a long chain aliphatic or cycloaliphatic oil such as castor oil, tung oil, linseed oil, naphthenic oils or mixtures thereof. The polysiloxanes are selected from the group consisting of polyalkylsioxanes, alkylpolysiloxanes, and mixtures thereof. Preferably the alkyl radial has from about one to about four carbon atoms, and mixtures thereof.

In the present invention aminofunctional polyalkyl siloxanes are preferred. Such aminofunctional polyalkylsiloxanes are commercially available products, such as those sold by Dow Corning under the tradenames DOW CORNING 531 and DOW CORNING 536. These products are described as aminofunctional polydimethylsiloxane copolymers with the following physical properties:

| | DOW CORNING 531 | DOW CORNING 536 |
|---|---|---|
| Active Ingredients(%) | 50 | 100 |
| Solvents | Aliphatic Solvents & Isopropyl alcohol | none |
| Viscosity @ 77° F.;(cs) | 150 | 35 |
| Refractive Index @ 77° F. | 1.410 | 1.408 |
| Specific Gravity | 0.860 | 0.985 |
| Flash Point, closed cup | 56 | 60 |

-continued

| | DOW CORNING 531 | DOW CORNING 536 |
|---|---|---|
| Pensky-Martin Method (°F.) | | |

In order to enhance the corrosion resistance of the aminofunctional polysiloxanes, they can be further reacted with a fatty acid; for example, one selected from the group consisting of acetic acid, stearic acid, isostearic acid, lauric acid, isomers and derivatives thereof as well as mixtures thereof.

The polymeric additive, as disclosed in U.S. Pat. No. 4,440,582 to Smith, contains between about 5% and about 35%, by volume, of the phosphating oil; between about 0.1 and about 25%, by volume, of the siloxane; and from about 50 to about 90%, by volume, water.

In the preferred embodiment, the aqueous coating composition is agitated by any suitable mechanical means to ensure homogeneity in composition and consistency in temperature. The aqueous coating composition is maintained at a temperature between about 100° F. and about 180° F. Preferably, the aqueous coating composition is maintained between about 140° F. and 180° F.

The metal piece to be coated is ordinarily dipped in the heated aqueous coating composition and permitted to remain in the composition for a period between about 10 second and about 2 minutes. For maximum effect, the metal piece is permitted to cool to approximately ambient temperature prior to dipping.

After dipping, the metal piece is removed from the aqueous coating composition. The composition is permitted to dry and cure at or above ambient temperatures for period between about 2 hours to about 2 days. The resulting part has greater corrosion resistance and wear characteristics than those parts which are either case hardened or surface coated.

Without being bound to any theory, it is believed that the aqueous coating composition permeates and interacts with the porous oxide layer such that the surface zone of the metal is rendered even more impervious to corrosion. In addition to this, the aqueous coating composition can also form a protective over-coating on the surface of the metal.

The following examples are provided to further disclose the present invention. These examples are for illustrative purposes and are not to be construed as limitative.

EXAMPLE I

A series of identical ferrous metal pieces are treated according to the method of the present invention. The pieces were each exposed to a first gaseous atmosphere consisting essentially of about 10 percent nitrogen, 50 percent ammonia and 40 percent natural gas for a period of about 3 hours while immersed in a fluidized bed at 1050° F. At the end of the 3 hours, the nitrogen, ammonia and natural gas atmosphere was replaced with a humidified nitrogen atmosphere containing of about 15 percent water, the balance being nitrogen. The metal pieces were exposed to the humidified nitrogen atmosphere at a temperature of 1050° F. for a period of about 60 minutes. The processed pieces had a surface zone which consisted of an oxide layer having a depth of about 0.0005 inch, a while layer immediately below the oxide layer having a depth of about 0.001 inch and a diffused nitrogen zone of about 0.006 inch deep.

The metal pieces were allowed to cool to room temperature and were dipped in an aqueous coating composition containing 20 percent by volume Ashland polymeric material in water. The aqueous coating composition was maintained at 140° F. with mechanical agitation. Each metal piece was maintained in solution for a period of 45 seconds after which it was removed and allowed to cure at room temperature for 24 hours. The resulting pieces have a dull black finish.

Thereafter the pieces are placed in a 22 inch Harshaw Salt Spray Cabinet and tested according to the test procedures outlined in American Society of Testing and Materials (ASTM) Procedure B-117 which is herein incorporated by reference. After 240 hours the pieces showed no rust.

EXAMPLE II

A series of identical ferrous metal pieces are treated in the manner outlined in Example I. However, immediately after exposure to the humidified nitrogen atmosphere, the pieces are immersed in an oxidizing salt bath containing nitrate salts. The pieces are held in the salt bath for a period of 30 minutes at 750° F. The resulting pieces have about 5/10 of a thousandth inch oxide layer; a 0.001 inch white layer and a 0.008 inch diffused nitrogen zone.

The metal pieces are, the, allowed to cool to room temperature and are coated with the aqueous coating composition in the manner described in Example I. When tested according to the procedures outlined in Example I, metal pieces treated in accordance with this procedure show no rust after 450 hours. On the average, rust was evident after about 750 hours.

EXAMPLE III

A series of identical ferrous metal pieces were treated essentially according to the method outlined in Example I. After the pieces were exposed to the nitrogen-ammonia-natural gas atmosphere for three hours at 1050° F. that atmosphere was replaced with an atmosphere consisting essentially of 15 percent water, 20 percent oxygen and 65 percent nitrogen at 1050° F. for a period of about 60 minutes. The processed pieces had surface zone having an oxide layer with a depth of about 0.0005 inch, a while layer immediately below the oxide layer having a depth of about 0.001 inch and a diffused nitrogen zone of about 0.006 inch deep.

The pieces were allowed to cool to room temperature and were further treated and tested according to the method outlined in Example I. The samples showed no rust after 240 hours in the salt spray test.

What is claimed is:

1. A method for improving the wear characteristics and corrosion resistance of the surface of a metal comprising the steps of:

A. case-hardening the surface of pieces of the metal, the case hardening step comprising:
   1. immersing the metal pieces in a fluidized bed of particulate material at a temperature between about 750° F. and about 1200° F.;
   2. introducing a first gaseous atmosphere into the bed, the first gaseous atmosphere selected from the group consisting of ammonia, nitrogen and natural gas while maintaining the temperature between about 750° F. and about 1200° F.
   3. maintaining the metal pieces in contact with the first gaseous atmosphere for a time period between about 1 and about 5 hours.
   4. promptly contacting the metal pieces with a second gaseous atmosphere containing nitrogen and water while said pieces are immersed in a fluidizing bed of particulate material at a temperature between about 750° F. and about 1200° F.
   5. maintaining the metal pieces in contact with the second gaseous atmosphere for a time period between about 30 minutes and about 90 minutes; and B. subsequent to the case-hardening step, contacting the case-hardened metal piece with an aqueous coating composition consisting essentially of:
   1. a phosphating oil;
   2. an aminofunctional alkylpolysiloxane or aminofuctional polyalkylsiloxane; and
   3. water;

C. allowing the coating composition retained on the metal piece to cure for a period between about 2 hours and about 48 hours.

2. The method of claim 1 further comprising the step of:

exposing the metal piece to an oxidizing salt at a temperature between about 650° F. and about 1000° F. for an interval between about 15 minutes and about 2 hours, the exposure to the oxidizing salt occurring prior to coating the metal piece with the aqueous coating composition.

3. The method of claim 2 wherein the metal piece is exposed to the oxidizing salt subsequent to exposure to humidified nitrogen.

4. The method of claim 1 wherein the fluidized bed is maintained at a temperature between about 900° F. and about 1000° F.

5. The method of claim 4 wherein the metal pieces are maintained in contact with the first gaseous atmosphere for about three hours.

6. The method of claim 5 further comprising the step of:

exposing the metal piece to an oxidizing salt medium for a period between about 15 minutes and about two hours, the exposure occurring prior to coating the metal piece with the aqueous coating composition, and taking place at a temperature between about 650° F. and about 1000° F.

7. The method of claim 1 wherein the aqueous coating composition consists essentially of:

a. between about 5 percent and about 35 percent, by volume, of the; phosphating oil
b. between about 0.1 and about 25 percent, by volume, of the siloxane; and
c. between about 50 percent and about 90 percent, by volume, water.

8. The method of claim 7 wherein:

a. the phosphating oil is a naphthenic oil, and
b. the siloxane is the reaction product of aminofunctional dimethylsiloxane and a fatty acid selected from the group consisting of acetic acid, stearic acid, isostearic acid and mixtures thereof.

9. The method of claim 7 wherein the aqueous coating composition is maintained at a temperature between about 100° F. to about 180° F.

10. The method of claim 9 wherein the aqueous coating composition is mechanically agitated.

11. The method of claim 9 wherein the metal piece to be coated is dipped into the aqueous coating composition and maintained therein or an interval between about 5 seconds and 5 minutes.

12. The method of claim 11 further comprising the step of:

exposing the metal piece to an oxidizing salt medium for a period between about 15 minutes and two hours at a temperature between about 650° F. and about 1000° F., the exposing step taking place prior to dipping the metal piece into the aqueous coating composition.

13. The method of claim 1 wherein the first gaseous atmosphere has a total flow rate exceeding 1200 cubic feet per hour wherein the ammonia has a flow rate of about 900 cubic feet per hour, the natural gas has a flow rate of about 350 cubic feet per hour and the nitrogen has a flow rate of about 250 cubic feet per hour.

14. The method of claim 1 wherein the second gaseous atmosphere has a flow rate between about 300 and about 900 cubic feet per hour and consists essentially of between about 10 percent to about 20 percent, by volume, water, the balance being nitrogen.

15. The method of claim 1 wherein the second gaseous atmosphere consists essentially of:

(a) between about 10 percent and about 20 percent, by volume, water;

(b) between about 10 percent and about 20 percent, by volume, oxygen; and (c) between about 30 percent and about 70 percent, by volume, nitrogen.

16. The method of claim 15 wherein the aqueous coating composition consists essentially of:

(a) between about 5 percent and about 35 percent, by volume, of the, aqueous coating additive the aqueous coating additive containing a phosphating oil selected from the group consisting of castor oil, tung oil, linseed oil, naphthenic oil, and mixtures thereof. and a polysiloxane; and (b) between about 65 and about 95 percent, by volume, water.

17. The method of claim 16 wherein the aqueous coating composition is maintained at a temperature between about 100° F. and about 180° F.

18. A method for improving wear characteristics and corrosion resistance of a metal comprising the steps of:

A. case hardening pieces of the metal, the case hardening step comprising:

1. immersing the metal pieces in a fluidized bed of particulate material at a temperature between about 900° F. and about 1000° F.;
2. introducing a first gaseous atmosphere into the bed, the atmosphere having a total flow rate exceeding 1200 cubic feet per hour while maintaining the temperature between about 900° F. and 1000° F., the first gaseous atmosphere selected from the group consisting essentially of ammonia, nitrogen and natural gas wherein the ammonia has a flow rate of about 900 cubic feet per hour, the nitrogen has a flow rate of about 250 cubic feet per hour and the natural gas has a flow rate of about 350 cubic feet per hour;
3. maintaining the work pieces in contact with the first gaseous atmosphere for a period of about three hours;
4. immediately replacing the first gaseous atmosphere with a second gaseous atmosphere upon completion of the 3 hour time period; the second gaseous atmosphere consisting essentially of about 10 percent to about 20 percent water and about 80 percent to about 90 percent nitrogen; and
5. maintaining the work piece in contact with the second gaseous atmosphere for a time period between about 30 minutes and about 40 minutes; and B. contacting the case hardened metal piece with an aqueous coating composition for an interval between about 5 seconds and 5 minutes, the aqueous coating composition maintained at a temperature between about 100° F. and about 180° F., the aqueous coating composition consisting essentially of:

1. between about 5 percent and about 35 percent, by volume, of a polymeric mixture containing a phosphating oil selected from the group consisting of castor oil, tung oil, linseed oil, and mixtures thereof;
2. an aminofunctional alkylpolysiloxane or an aminofunctional dimethyl siloxane; and
3. between about 65 percent and about 95 percent, by volume, water; and C. allowing the coating composition retained on the metal piece to cure for an interval between about 2 hours and about 48 hours.

19. The method of claim 18 further comprising the step of:

exposing the metal piece to an oxidizing salt medium for a period between about 15 minutes and about 2 hours, the exposure occurring prior to coating the metal piece with the aqueous coating composition, and taking place at a temperature between about 650° F. and about 1000° F.

20. A method for improving the wear characteristics and corrosion resistance of the surface of a metal comprising the steps of:

A. case-hardening the surface of pieces of the metal, the case hardening step comprising:

1. immersing the metal pieces in a fluidized bed of particulate material at a temperature between about 750° F. and about 1200° F.;
2. introducing a first gaseous atmosphere into the bed, the first gaseous atmosphere selected from the group consisting of ammonia, nitrogen and natural gas while maintaining the temperature between about 750° F. and about 1200° F.;
3. maintaining the metal pieces in contact with the first gaseous atmosphere for a time period between about 1 and about 5 hours;
4. imparting a porous oxide layer on the surface of the metal pieces, the imparting step comprising contacting the metal pieces with a second gaseous atmosphere containing nitrogen and water while the metal pieces are immersed in a fluidized bed of particulate material at a temperature between about 750° F. and about 1200° F.;
5. maintaining the metal piece in contact with the second gaseous atmosphere for a time period between about 30 minutes and about 90 minutes; and B. subsequent to the case-hardening step, incorporating an aqueous coating composition into the porous oxide layer on the surface of the metal pieces, the aqueous coating composition consisting essentially of:

1. a phosphating oil selected from the group consisting of castor oil, tung oil, linseed oil, naphthenic oil, and mixtures thereof;
2. a reaction product of an aminofunctional polyalkylsioxane and a fatty acid slected from the group consisting of acetic acid, stearic acid, isosteric acid and mixtures thereof; and
3. water.

* * * * *